US006802463B2

(12) United States Patent
Dankert

(10) Patent No.: US 6,802,463 B2
(45) Date of Patent: Oct. 12, 2004

(54) SPRAY-COATING SYSTEM

(75) Inventor: Manfred Dankert, Rodenmark (DE)

(73) Assignee: ITW Oberflachentechnik GmbH & Co. KG (DE)

( * ) Notice: Subject to any disclaimer, the term of this patent is extended or adjusted under 35 U.S.C. 154(b) by 12 days.

(21) Appl. No.: 10/227,457

(22) Filed: Aug. 26, 2002

(65) Prior Publication Data

US 2003/0042339 A1 Mar. 6, 2003

(30) Foreign Application Priority Data

Aug. 29, 2001 (DE) ..... 101 42 074

(51) Int. Cl.[7] ..... B05B 1/00

(52) U.S. Cl. ..... 239/600; 239/487.1; 239/587.2; 239/587.5; 239/587.6; 248/681

(58) Field of Search ..... 239/487.1, 587.2, 239/587.5, 587.6, 600; 248/681, 680, 500

(56) References Cited

U.S. PATENT DOCUMENTS

| | | | | | |
|---|---|---|---|---|---|
| 2,859,728 | A | * | 11/1958 | Hobdy | 239/514 |
| 4,230,023 | A | * | 10/1980 | Ward | 248/500 |
| 4,602,742 | A | * | 7/1986 | Penson | 239/587.2 |
| 5,624,075 | A | * | 4/1997 | Dankert | 239/600 |
| 6,478,242 | B1 | * | 11/2002 | Knobbe et al. | 239/600 |

FOREIGN PATENT DOCUMENTS

| | | | | |
|---|---|---|---|---|
| DE | 10180163 A | * | 7/1998 | B05B/15/06 |
| EP | 0 846 498 A1 | | 6/1998 | |

* cited by examiner

*Primary Examiner*—Thomas Denion
*Assistant Examiner*—Theresa Trieu
(74) *Attorney, Agent, or Firm*—Lowe Hauptman Gilman & Berner LLP

(57) ABSTRACT

A spray-coating system includes a spraying implement (2) affixable to a support (4) by a tightening element (26) which is affixed to one of the implement and the support (2, 4) so as to be rotatable relative to both parts (2, 4).

26 Claims, 3 Drawing Sheets

SPRAY-COATING SYSTEM

FIELD OF THE INVENTION

The present invention relates to a spray-coating system.

Accordingly the invention relates to the spray-coating system containing a spraying implement, a support to which the spraying implement may be affixed in detachable manner by clamping means, first fluid-transmitting duct ends of fluid-transmitting ducts in the support configured opposite other, second fluid-transmitting duct ends of other fluid-transmitting ducts in the spraying implement and serving to convey fluids in-between when the spraying implement is affixed to the support, further containing seals at the fluid-transmitting duct ends to mutually seal the support and the spraying implement, said clamping means allowing to clamp the spraying implement against the support and the in-between seals being compressed.

BACKGROUND OF THE INVENTION

The spray-coating system is especially well suited for spray-coating using liquid coating materials, through it also may be designed to spray-coat powders conveyed in a pressurized-gas flow, preferably a flow of compressed air.

A spray-coating system of this kind is known from the European patent document 0 846 498 A1. Therein, instead of a separately rotatable tightening element, it is the spraying implement itself which rotates in order to rotate a tightening element which is affixed to it relative to a support in order to clamp the latter two elements. In the course of this rotation, O rings between said implement and support being clamped in fluid-transmitting duct ends they contain. These seals only partly enter recesses in the spraying implement. The transverse motions taking place during clamping and releasing will abrasively shear said seals. Accordingly these seals must be exchanged on account of wear after the spraying implement has been mounted on and removed from the support several times. The support is in the form of an adapter's plate which can be screwed tightly on a rest. This adapter makes it possible to affix the same or different spray-coating devices all designed with the same configuration of fluid-transmitting duct ends to a number of different rests such as robot arms or jacks exhibiting different configurations of fluid-transmitting ducts, and the same control programs may be used in all applications to drive the spray-coating system.

SUMMARY OF THE INVENTION

The objective of the invention is to reduce the seal wear between the spraying implement and the support in simple and economical manner and thereby to extend seal life and to preclude leakage flows when the coating material or other fluids, for instance compressed air or gas, solvents etc. are highly pressurized.

This goal is attained by clamping means that comprise a tightening element which is affixed to either of the group of spraying implement and support so as to be rotatable relative to it and comprises a first clamping surface, a second clamping surface being present at the other of said spraying implement or support, the axis of rotation of said tightening element being in the direction of tightening wherein the spraying implement and the support may be clamped against each other, and rotation of the tightening element relative said spraying implement and support allows rotating the first clamping surface while being clamped to the second clamping surface in order to clamp the spraying implement against the support and thereby to clamp the seals in-between.

Both in the present specification and the claims, the term "fluid" is considered in its basic form including especially "liquid", in particular coating liquids or a solvent, gases, especially compressed air, and a flow of compressed air containing coating powder.

BRIEF DESCRIPTION OF THE DRAWINGS

The invention is elucidated below by means of a preferred embodiment and in relation to the attached drawings.

DETAILED DESCRIPTION OF THE INVENTION

Figure 1:
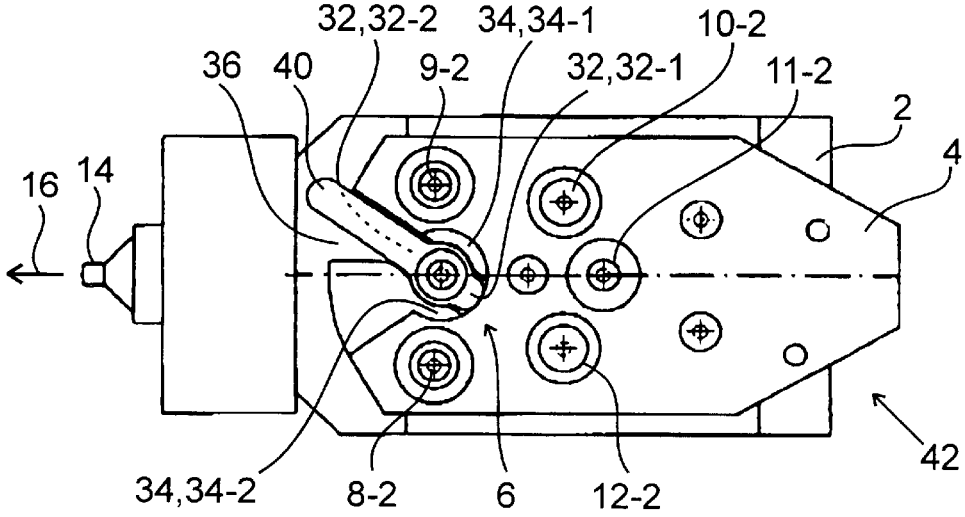
FIG. 1 is an bottom view of the spray-coating system of the invention showing the superposed spraying implement and support as yet not clamped to each other, and a tightening element in an angular position of separation.

The spray-coating system of the invention shown in the drawings is designed to spray a liquid coating material, for instance varnish. In another embodiment, it may be used to spray pneumatically conveyed powder coating material.

The spray-coating system of the invention contains a spraying implement 2 and a support 4 which are detachably affixed to each other by clamps 6. Furthermore fluid-transmitting duct ends 8, 9, 10, 11 and 12 in the form of boreholes or similar apertures are fitted in the spraying implement 2 and are opposite respectively fluid-transmitting duct ends 8-1, 9-1, 10-1, 11-1 and 12-1 for fluid transmission between them when the spraying implement 2 is clamped against and thus affixed to the support 4. The fluid-transmitting ducts in the support 4 also consist of boreholes or similar apertures. As shown in the drawings, the spraying implement 2 is substantially rectangular and preferably made of plastic or metal and comprises at its front end a spray nozzle 14 to spray the coating material 16 in the direction of the arrow 16. Preferably the support 4 shall also be made of plastic or metal and it assumes the form of an adapter plate of an omitted adapter serving to geometrically match the fluid-transmitting duct ends 8, 9, 10, 11 and 12 of the spraying implement 2 to the geometric array of fluid lines of a rest to which the adapter may be affixed and which illustratively may be a robot arm or raising support. As a result, different geometric configurations of fluid lines of such a support do not entail different spraying implements, but instead the same spraying implement may always be used or different spraying implements with the same configuration of fluid-transmitting ducts of said rest may always be used by resort to different adapters. Consequently the same operational, i.e. computer, program for the spraying implement 2 may be used for different geometric line configurations.

Figure 3:
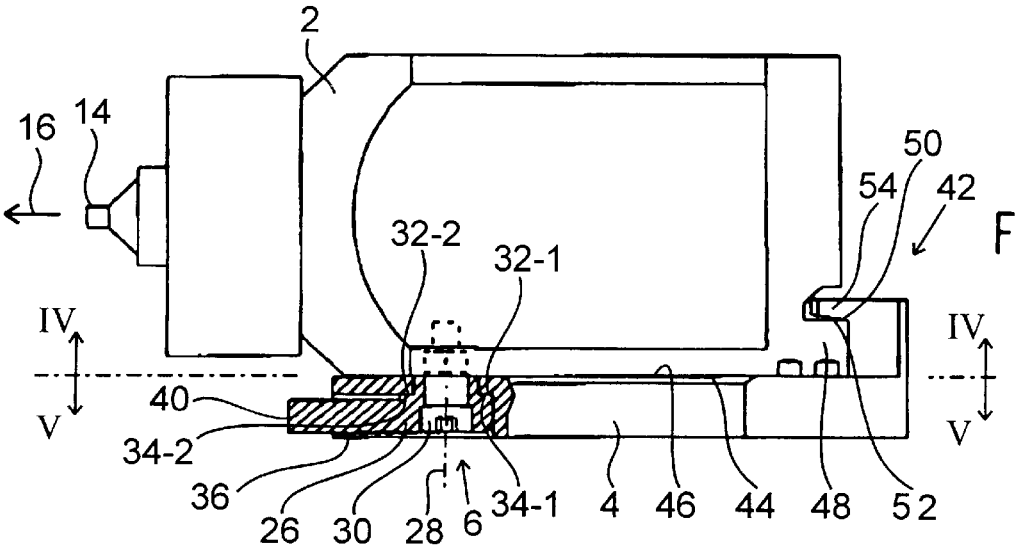
FIG. 3 is a sideview of the coat-spraying device of the invention wherein the spraying implement was partly clamped onto the support but a tightening element has not yet reached its final clamped angular position of FIG. 2.
Figure 4:
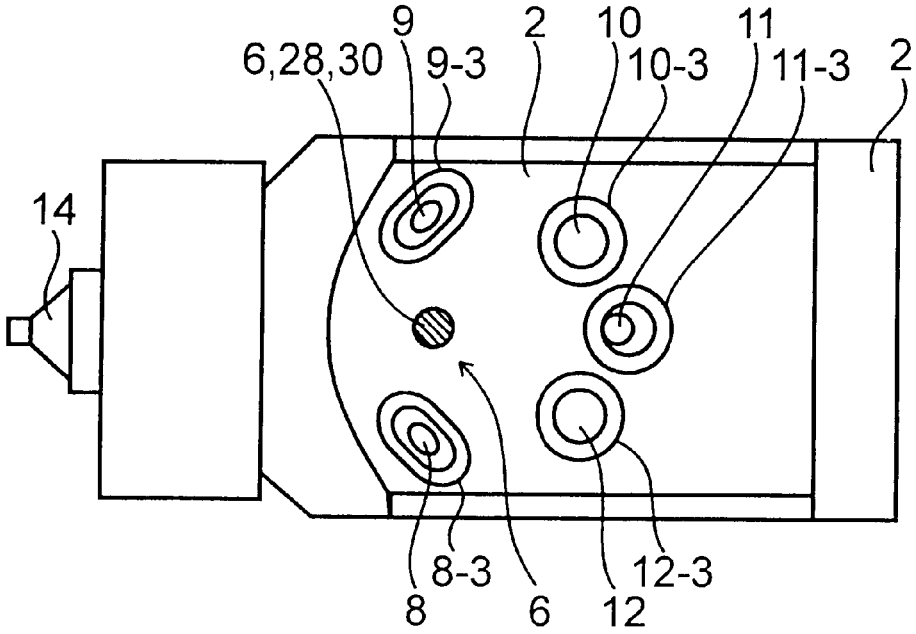
FIG. 4 is a bottom view of the spraying implement along the plane IV—IV of FIG. 3, without the support.
Figure 5:
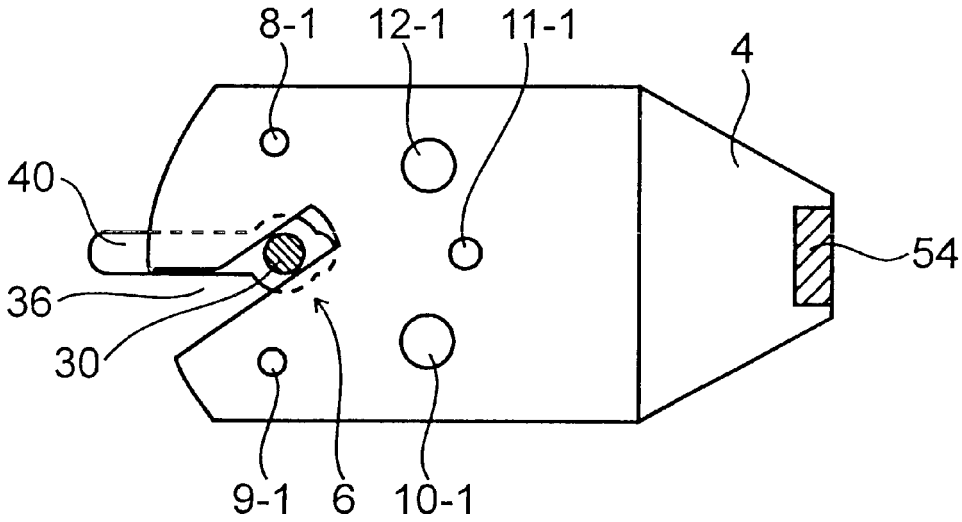
FIG. 5 is a topview of the support along the plane V—V of FIG. 3.

The fluid-transmitting duct ends 8, 9, 10, 11 and 12 of the spraying implement 2 are shown in FIG. 4 and the fluid-transmitting duct ends 8-1, 9-1, 10-1, 11-1 and 12-1 of the plate support 4 and aligned with the former respective fluid-transmitting duct ends are shown in FIG. 5. On the pertinent side of the support 4, FIGS. 1 and 3 show the associated outer fluid-transmitting duct ends 8-2, 9-2, 10-2, 11-2 and 12-2 of the fluid-transmitting ducts configured in the support 4, said latter ducts when hooked up to an omitted rest being connected for fluid transmission with fluid lines fitted on or in the said rest.

Within the scope of the present invention, the term "fluid" may denote a liquid, in particular a coating liquid or a solvent, a gas, for instance compressed air, a mixture of compressed air and powder used as a coating material or another medium able to flow. In the preferred embodiment, which is the one shown in the drawings, the fluid line of the fluid-transmitting duct end 8 serves as the feed of coating material into the spraying element 2; the fluid-transmitting duct end 9 is used for the return of coating material from the spraying implement 2 during pauses in spray coating; the fluid-transmitting duct end 10 is used for atomizing air to assist the atomization of the coating material at the spray nozzle 14; the fluid-transmitting duct end 11 is used for compressed-air control to drive an omitted valve contained in the spraying implement, the coating material being able to flow from the feed fluid-transmitting duct end 8 when said valve is opened toward the spray nozzle 14, and, when said valve is in its closed position, the coating material is thereby able to flow from the feed fluid-transmitting duct end 8 to the return fluid-transmitting duct end 9 instead of toward the spray nozzle 14, in the manner for instance known from the European patent document 0 846 498 A1 of which the disclosure is incorporated herein; the fluid-transmitting duct end 12 is for air shaping, where said air, in order to shape the spray jet, is allowed to flow around the aperture of the nozzle 14 in the manner already known for instance from the above cited European patent document 0 846 498 A1.

A seal in the form of an O ring 8-3, 9-3, 10-3, 11-3 and 12-3 is respectively mounted between the fluid-transmitting duct ends 8 and 8-1, 9 and 9-1, 10 and 10-1, 11 and 11-1, 12 and 12-1. These seals may be mounted in recessed manner in offsets of the fluid-transmitting ducts of either of the spraying implement 2 and support 4, preferably they shall be configured in the spraying implement 2 and shall slightly project from said implement's surface 44 for instance by 0.1 to 0.5 mm in order to seal against pressurized fluid in leakage proof manner when the spraying implement 2 and the support 4 are mutually compressed. Preferably the seals are made of a resilient, material compressible material such as rubber.

The spraying implement 2 is affixed to the support 4 by being compressed by the clamping means 6 against this support 4, the sandwiched seals 8-3 through 12-3 thereby being compressed.

The clamping means contains a tightening element 26 rotatable relative to both the spraying implement 2 and the support 4 about an axis of rotation 28 which is subtended parallel to the direction of clamping by a screw 30 allowing to rotatably affix the tightening element 26 to the spraying implement 2 on the side facing the support 4. In another embodiment, the tightening element 26 is rotatably affixed not to the spraying implement 2 but to the support 4. In the longitudinal direction of the axis of rotation and at a gap from the spraying implement 2, the tightening element 26 comprises a first clamping surface 32 running and extending transversely to the axis of rotation 28 and pointing toward the spraying implement 2. A second clamping surface 34 is constituted at the support 4 and points away from the spraying element 2. Preferably each clamping surface 32 and 34 consists of two partial-surfaces 32-1 and 32-2 and 34-1 and 34-2 respectively which are configured approximately diametrically to each with respect to the axis of rotation.

Figure 2:
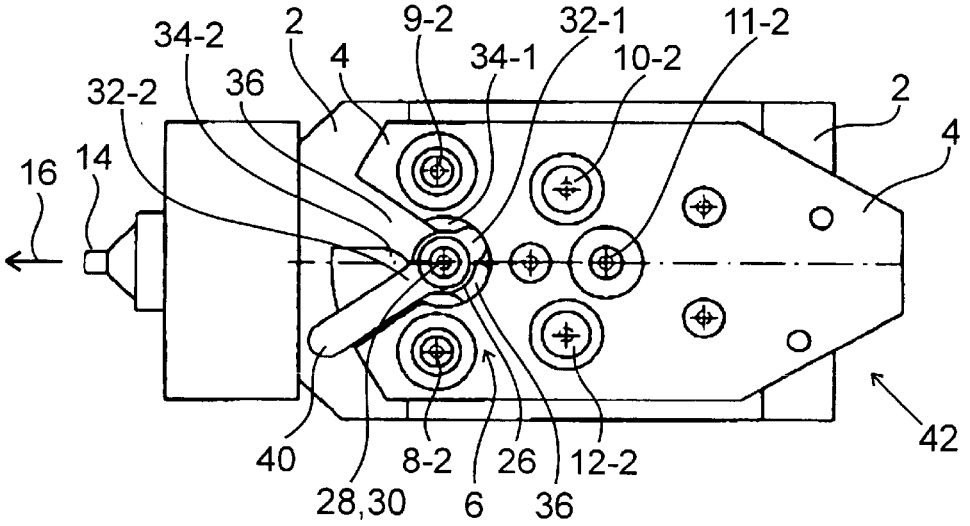
FIG. 2 is a bottom view of the spray-coating system of the invention, the spraying implement being clamped to the support on account of the tightening element having been rotated relatively both to the spraying implement and the support into the angular position of clamping.

A recess 36 is subtended in the support 4 next to the second clamping surface 34 and allows passing the tightening element 26 in the longitudinal direction of the axis of rotation 28 when the spraying implement 2 is set on the support 4, whereby both clamping surfaces 32 and 34 come to assume an adjacent position in an angular position of separation corresponding to FIG. 1, whereupon, when the tightening element 26 shall be rotated into the angular position of clamping of FIG. 2, its first clamping surface 32 can be rotated onto the second clamping surface 34 of the support 4. In this process the spraying implement 2 is drawn against the tightening element 26 and the sandwiched O-rings 8-3 through 12-3 shall be compressed.

Figure 6:
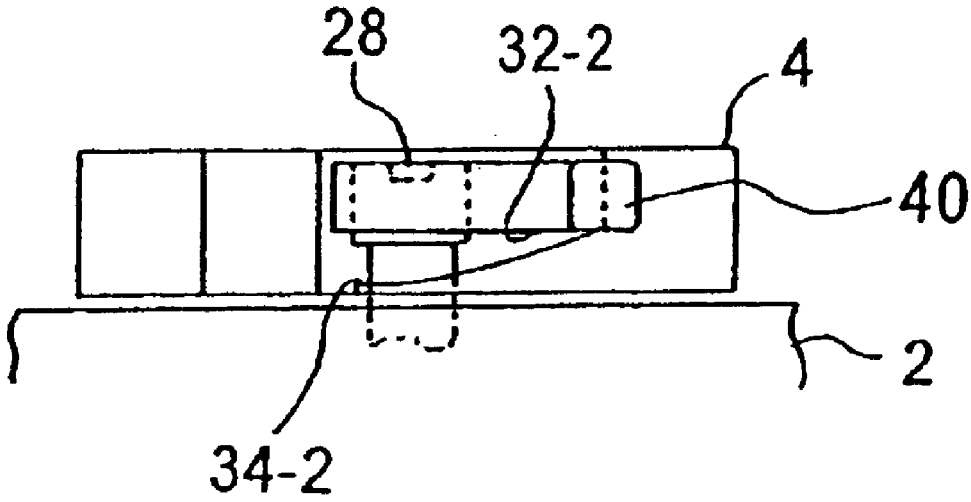
FIG. 6 is a partial left end view of FIG. 2.

When said seals are made of a soft, resilient material, they may be compressed manually between the spraying implement 2 and the support 4 in a manner that the two clamping surfaces 32 and 34 may be mutually rotated from a height-offset mutual position which does not overlap into a mutual position which does overlap. In that case the clamping surfaces 32 and 34 may be planes running in a plane that is radial to the axis of rotation 28. More practically, however and especially in the case the seals consist of a harder material, one or both clamping surfaces 32 and 34 ascending like a thread (as can be seen at 34-2 in FIG. 6) around the axis of rotation 28 or pointing toward the other clamping surface in order that by manually rotating the tightening element 26 the spraying implement 2 shall be drawn, against the opposing force of said seals or O-rings, against the support 4. In the clamped angular position of FIG. 2, the two clamping surfaces 32 and 34 shall rest against each other. To assemble the spraying implement 2 to and disassemble it from the support 4, the tightening element 26 is rotated into the angular position of separation of FIG. 1 wherein the clamping surfaces 32 and 34 are adjacent but not overlapping and the tightening element 26 may be displaced through the recess 36 by lifting the spraying implement 2 from the support 4, said recess 36, as already mentioned above, being subtended in this support.

Preferably the tightening element 26 is fitted with a manual-operation handle 40 in order to eliminate the need for a tool such as a screwdriver or a wrench to assemble the spraying implement 2 to or disassemble it from the support 4.

The handle 40 runs transversely to the axis of rotation 28 and preferably beyond the support 4 whereby said handle may be actuated outside said support and next to the spraying implement 2 for the purpose of clamping or releasing said spraying implement. In the preferred embodiment of the present invention, the recess 36 is a slot comprising an open end transverse to the axis of rotation 28, the handle being able to pass through said open end on account of the assembly motion of the spraying implement 2 and the support 4.

The angular range through which the tightening element 26 is rotated between the angular position of clamping of FIG. 2 and the angular position of separation of FIG. 1 may be small, for instance merely 10°. The angle of rotation is less than 360°, preferably even less than 180°. In the shown embodiment it is only about 70°.

In the preferred embodiment of the invention, a latch 42 is situated radially away from the axis of rotation 28 beyond at least one of said seals and keeps the spraying implement 2 parallel to the said axis of rotation and against the support 4. The spraying implement 2 and the support 4 can be joined into each other transversely to the axis of rotation at said latch 42 before they are tightened to each other in the longitudinal direction of the axis of rotation 28. Preferably the latch 42 shall be situated relative to the axis of rotation 28 radially outside the region of the seals 8-3 through 12-3.

During assembly, the spraying implement 2 and the support 4 are joined at the latch 42 transversely to the axis of rotation 28 as indicated in FIG. 1. The handle 40 then assumes the angular position of separation shown in FIG. 1. Thereupon the tightening element 26 is tightened into the spray system shown in FIG. 2 by the clamping surfaces 32 and 34 against the spring force of the seals 8-3 through 12-3 against the support 4.

The latch 42 is fitted at the spraying implement 2 with a latch surface 50 at a first protrusion or offset 48 pointing away from the axis of rotation 28, said surface 50 pointing in the direction opposite that of the fluid transmitting duct ends 8, 9, 10, 11 and 12, said first latch surface 50 engaging underneath the bottom of a second latch surface 52 constituted at an oppositely directed offset or protrusion 54 of the support 4 and pointing in a direction opposite that of its fluid transmitting duct ends 8-1, 9-1, 10-1, 11-1 and 12-1. The second offset 54 points toward the axis of rotation 28 and its second latch surface 52 points in the longitudinal direction of the axis of rotation.

Preferably the latch 42 shall be situated at the rear end and the tightening element 26 with the tightening element 28 shall be situated at the front end of the spraying implement 2.

The latch 42 and the tightening element 26 are configured at sites where they do not interfere with the fluid-transmitting ducts. The axis of rotation 28 may be configured within or without the array of the fluid-transmitting duct ends 8 through 12 and 8-1 through 12-1. Uneven stressing of the seals 8-2 through 12-2 may be at least partly compensated by the latch 42. The latch 42 requires no locking elements to lock the spraying implement 2 to the support 4. The latch 42 prevents, or at least reduces, detaching the spraying implement 2 off the support 4, that is, it keeps the spraying implement "down" on the support 4. This simplified description also applies to embodiment modes wherein the spraying implement 2 is mounted underneath or next to the support 4.

The latch 42 is constituted between the spraying implement 2 and the support 4 and preferably it shall be integral with both components. Said range points transversely to the axis of rotation 28 for the purpose of interconnecting the spraying implement 2 and the support 4 transversely to said axis of rotation when the clamping surfaces 32, 34 assumes their non-overlapping positions of separation.

The latch 42 and the tightening element 26 are radially offset from each other with respect to the axis of rotation 28 at a distance beyond the seals. In other embodiments, the latch 42 may be divided into two components configured in mutually opposite and diametrical manner relative to the axis of rotation 28.

The latch surface 50 of the spraying implement 2 runs in a direction which is opposite that of said implement's fluid transmitting duct ends 8, 9, 10, 11 and 12. The latch surface 52 of the support 4 runs in the opposite direction of said surface's fluid transmitting duct ends 8-1, 9-1, 10-1, 11-1 and 12-1.

The latch 42 preferably is mounted transversely to the axis of rotation 28 outside the zone of the fluid transmitting duct ends.

Preferably the axis of rotation 28 is configured transversely and in a direction opposite to it like the latch 42 outside the center of the totality of the fluid transmitting duct ends 8 through 12 and 8-1 through 12-1.

Preferably the position of the latch surfaces 50 and 52 relative to the transmitting fluid-transmitting duct ends and to the seals is selected in a manner that no gap arises, or only a gap of 1.0 mm or preferably of 0.5 mm or less shall arise between the mutually overlapping latch surfaces 50, 52 when the spray implement 2 and the support 4 and the seals 8-3, 9-3, 10-3, 11-3, 12-3 between them are superposed without being compressed by the tightening element 26.

Preferably the seals 8-3 through 12-3 only project by 0.1 to 0.3 mm above the surfaces 44 and 46 respectively of the spraying implement 2 and support 4 wherein they are countersunk. Preferably they shall be compressed only little by the clamping of the tightening element 26. Three embodiment variations are feasible. In the first variation, the latch surfaces 50, 52 are separated by only a slight gap less than 1.0 mm when the spraying implement 2 and the support 4 and the seals between them rest on each other in the absence of clamping by the tightening element 26. In this case the gap preferably is only 0.1 to 0.3 mm. As a result, when the two said parts are joined in the latch 42, that part not receiving the seals shall reliably be precluded from damaging the seals by one of its edges. Nevertheless the latch 42 contributes to keeping both the spraying implement 2 and the support 4 together in fluid-tight manner even when external forces are exerted. In the second variation the said gap is 0.0 mm. In this case too abrasion caused by one part, for instance the support 4, on the seals, may be averted provided the spraying implement 2 and the support 4 shall be joined in careful manner. In the third variation the gap is less than 0.0 mm, and consequently, when the tightening element 26 is released, the joined parts, namely the spraying implement 2 and the support 4, shall be configured by the latch 42 to be obliquely rising on that seal which is nearest said latch and shall be moved into a mutually more parallel configuration when said two parts are clamped together by the tightening element 26, said two parts in said latter configuration resting in fluid-tight manner on all seals and assuring leakage-proof sealing at said seals even at high fluid pressures. In this third variation again the spraying implement 2 and the support 4 can be joined without damaging the seals.

What is claimed is:

1. A spray-coating system, comprising:

a spraying implement having first fluid-transmitting ducts;

a support to which said spraying implement may be detachably affixed, said support having second fluid-transmitting ducts running therein;

clamping means for detachably affixing said spraying implement to said support;

fluid-transmitting duct ends of said second fluid-transmitting ducts running in the support being configured opposite fluid-transmitting duct ends of said first fluid-transmitting ducts in the spraying implement in order to transmit fluid between said first and second fluid-transmitting ducts when the spraying implement is affixed to the support; and seals at the fluid-transmitting duct ends to mutually seal the support and the spraying implement, the spraying implement being clampable by the clamping means against the support and, thereby, said seals being compressible between the spraying implement and the support;

wherein the clamping means comprise a tightening element which is affixed to and rotatable about one of the spraying implement and the support and which comprises a first clamping surface;

a second clamping surface is provided by the other of the spraying implement and the support;

the axis of rotation of the tightening element runs in the direction of clamping in which the spraying implement and the support can be clamped; and by rotating the tightening element relative to said spraying implement and said support, the first clamping surface clamping the second clamping surface is rotated jointly with the tightening element in order to clamp the spraying implement against the support, thereby compressing the seals between the spraying implement and the support.

2. The system as claimed in claim 1, wherein at least one of the two clamping surfaces extends around the axis of rotation over an angular range of less than 360° and the other clamping surface extends over less than the remaining angular range around the axis of rotation;

the tightening element is rotatable relative to both the spraying implement and the support between an angular position of separation, where the clamping surfaces are in adjacent and non-overlapping angular ranges, and an angular position of clamping, where the two clamping surfaces overlap at least partly and are clamped together; and the other of the spraying implement and the support to which the tightening element is not affixed has a recess which defines a passage through which the tightening element is rotatable between the angular position of separation and the angular position of clamping to move the clamping surfaces towards and away from each other in the longitudinal direction of the axis of rotation.

3. The system as claimed in claim 1, wherein at least one of the clamping surfaces is rising like a thread toward the other clamping surface within a partial range around the axis of rotation.

4. The system as claimed in claim 1, wherein the tightening element includes a handle for manual operation.

5. The system as claimed in claim 4, wherein the handle is a lever running transversely from the axis of rotation and ending at an end located beyond the other of the spraying implement and the support which has the second clamping surface, so that said end is externally manually accessible.

6. The system as claimed in claim 1, wherein the relative angle of rotation of the two clamping surfaces between the angular position of clamping and the angular position of separation is equal to or less than 180°.

7. The system as claimed in claim 1, wherein a latch is constituted between the spraying implement and the support and runs in an assembling direction of the spraying implement and the support transverse to the axis of rotation when the tightening element assumes the angular position of separation.

8. The system as claimed in claim 7, wherein the latch and the tightening element are configured radially to the axis of rotation at a mutual distance that runs at least beyond one of the seals.

9. The system as claimed in claim 7, wherein the latch comprises a first latch surface provided by the spraying implement and a second latch surface provided by the support, said two latch surfaces being configured away from the axis of rotation and mutually opposite in the longitudinal direction of the axis of rotations;

the first latch surface of the spraying implement faces away from the fluid-transmitting duct ends of said first fluid-transmitting ducts; and the second latch surface of the support faces away from the fluid-transmitting duct ends of said second fluid-transmitting ducts.

10. The system as claimed in claim 9, wherein no gap or only a gap less than 1.0 mm is present between the latch surfaces when the spray implement and the support and the seals therebetween are superposed in the absence of compression by the tightening element.

11. The system as claimed in claim 9, wherein at least one of the latch surfaces is provided by an offset or protrusion running in the direction between the axis of rotation of the tightening element and the latch.

12. The system as claimed in claim 7, wherein the latch is configured at a radial distance from the axis of rotation outside the fluid-transmitting duct ends.

13. The system as claimed in claim 7, wherein the axis of rotation and the latch are positioned on opposite sides of the fluid-transmitting duct ends.

14. A spray-coating system, comprising:

a spraying implement having at least one first fluid-transmitting duct;

a support having at least one second fluid-transmitting duct;

a tightening element which is rotatably attached to one of the spraying implement and the support for detachably affixing said support to said spraying implement, said tightening element comprising a first clamping surface, the other of the spraying implement and the support comprising a second clamping surface;

said first and second fluid-transmitting ducts having first and second fluid-transmitting duct ends, respectively, said first fluid-transmitting duct ends being configured opposite said second fluid-transmitting duct ends, when said spraying implement is affixed to said support by said tightening element, to allow fluid transmission between said first and second fluid-transmitting ducts; and at least one seal between said first and second fluid-transmitting duct ends to mutually seal the support and the spraying implement, said seals being compressible between the spraying implement and the support when said spraying implement is affixed to said support by said tightening element;

wherein the tightening element has an axis of rotation and is rotatable about said axis of rotation between an angular position of separation and an angular position of clamping; and a movement of said tightening element from said angular position of separation to said angular position of clamping brings the first and second clamping surfaces towards each other in the direction of said axis of rotation, so as to clamp the spraying implement against the support, thereby compressing the seal between the spraying implement and the support.

15. The system as claimed in claim 14, wherein at least one of the first and second clamping surfaces extends around the axis of rotation over an angular range of less than 360° and the other clamping surface extends over less than the remaining angular range around the axis of rotation;

the tightening element is rotatable relative to both the spraying implement and the support between the angular position of separation, where the clamping surfaces are in adjacent and non-overlapping angular ranges, and the angular position of clamping, where the clamping surfaces overlap at least partly and are clamped together; and the other of the spraying implement and the support to which the tightening element is not attached has a recess which defines a passage through which the tightening element is rotatable between the angular position of separation and the angular position of clamping to move the clamping surfaces towards and away from each other in the direction of the axis of rotation.

16. The system as claimed in claim 14, wherein at least one of the clamping surfaces is a ramp surface extending toward the other clamping surface within a partial range around the axis of rotation.

17. The system as claimed in claim 14, wherein the tightening element includes a handle for manual operation.

18. The system as claimed in claim 17, wherein the handle extends transversely of and from the axis of rotation and ends at an end located beyond the other of the spraying implement and the support which has the second clamping surface, so that said end is manually accessible by an operator.

19. The system as claimed in claim 14, wherein the angular position of clamping and the angular position of separation is angularly spaced by no more than 180°.

20. The system as claimed in claim 14, wherein the spraying implement further engages the support at a latch portion rather than said tightening element.

21. The system as claimed in claim 20, wherein the latch portion is farther from said axis of rotation than said seal.

22. The system as claimed in claim 20, wherein the latch portion comprises a first latch surface provided by the spraying implement and a second latch surface provided by the support, said first and second latch surfaces facing each other in the direction of said axis of rotation and being spaced from the axis of rotation;

the first latch surface of the spraying implement faces away from the first fluid-transmitting duct ends of said first fluid-transmitting ducts; and the second latch surface of the support faces away from the second fluid-transmitting duct ends of said second fluid-transmitting ducts.

23. The system as claimed in claim 22, wherein no gap or only a gap less than 1.0 mm is present between the latch surfaces when said tightening element is in said angular position of separation.

24. The system as claimed in claim 22, wherein at least one of the latch surfaces is provided by an offset or protrusion extending in a direction between the axis of rotation of the tightening element and the latch portion.

25. The system as claimed in claim 20, wherein the latch portion is farther from said axis of rotation than said first and second fluid-transmitting duct ends.

26. The system as claimed in claim 20, wherein the axis of rotation and the latch portion are positioned on opposite sides of the first and second fluid-transmitting duct ends.

* * * * *